US011647824B2

(12) United States Patent
Shin et al.

(10) Patent No.: US 11,647,824 B2
(45) Date of Patent: May 16, 2023

(54) COSMETIC CONTAINER

(71) Applicant: LG HOUSEHOLD & HEALTH CARE LTD., Seoul (KR)

(72) Inventors: Ho Jun Shin, Seoul (KR); Gu Yong Lee, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 309 days.

(21) Appl. No.: 16/995,431

(22) Filed: Aug. 17, 2020

(65) Prior Publication Data

US 2021/0059384 A1 Mar. 4, 2021

(30) Foreign Application Priority Data

Sep. 4, 2019 (KR) ..... 10-2019-0109631

(51) Int. Cl.
*A45D 40/22* (2006.01)
*A45D 33/00* (2006.01)

(52) U.S. Cl.
CPC ..... *A45D 40/221* (2013.01); *A45D 33/006* (2013.01); *A45D 40/222* (2013.01); *A45D 2040/225* (2013.01)

(58) Field of Classification Search
CPC .. A45D 40/221; A45D 33/006; A45D 40/222; A45D 40/225
See application file for complete search history.

(56) References Cited

U.S. PATENT DOCUMENTS

| | | | | |
|---|---|---|---|---|
| 2,015,712 | A * | 10/1935 | Chesler | A45D 40/221 132/305 |
| 6,002,651 | A * | 12/1999 | Baccaray | A45D 33/30 368/278 |
| 7,055,216 | B2 * | 6/2006 | Seidler | E05D 7/1044 16/320 |
| 9,452,873 | B2 * | 9/2016 | Eberlein | A45D 33/006 |
| RE46,854 | E * | 5/2018 | Byeon | A45D 33/006 |
| 9,999,286 | B2 * | 6/2018 | Wu | B65D 43/167 |
| 10,070,711 | B2 * | 9/2018 | Kim | A45D 33/24 |
| 10,159,324 | B2 * | 12/2018 | Dinata | A45D 33/24 |
| 10,219,603 | B2 * | 3/2019 | Tatin | A45D 40/22 |
| 10,292,478 | B2 * | 5/2019 | Montoli | A45D 33/008 |
| 10,334,931 | B2 * | 7/2019 | Kim | A45D 40/221 |
| 10,334,932 | B1 * | 7/2019 | Huang | A45D 33/006 |
| 10,349,723 | B2 * | 7/2019 | Kim | A45D 40/221 |
| 10,881,185 | B2 * | 1/2021 | Denece | A45D 40/222 |

(Continued)

FOREIGN PATENT DOCUMENTS

| | | |
|---|---|---|
| CN | 207355692 U | 5/2018 |
| JP | 7-19369 Y2 | 5/1995 |

(Continued)

*Primary Examiner* — Victor D Batson
*Assistant Examiner* — Matthew J Sullivan
(74) *Attorney, Agent, or Firm* — Birch, Stewart, Kolasch & Birch, LLP

(57) ABSTRACT

Provided herein may be a cosmetic container including a main body configured to store cosmetics therein; a cover configured to open and close a first side of the main body; and a hinge part configured to hingedly connect the cover to the main body. The hinge part includes a shaft insert part protruding from an upper end of the main body, with a hinge shaft being inserted into the shaft insert part; and a shaft coupling part depressed in the cover to be at a position corresponding to the shaft insert part, and securing both ends of the hinge shaft.

15 Claims, 10 Drawing Sheets

(56) References Cited

U.S. PATENT DOCUMENTS

| | | | | |
|---|---|---|---|---|
| 2010/0307521 | A1* | 12/2010 | Pires | A45D 33/006 220/736 |
| 2014/0261530 | A1 | 9/2014 | McNamara | |
| 2018/0317625 | A1* | 11/2018 | Lee | B65D 77/04 |
| 2019/0116957 | A1* | 4/2019 | Montoli | A45D 40/221 |
| 2019/0365074 | A1* | 12/2019 | Kikuchi | A45D 33/08 |
| 2020/0008556 | A1* | 1/2020 | Kim | A45D 33/006 |
| 2020/0054112 | A1* | 2/2020 | Lee | A45D 40/22 |
| 2020/0397120 | A1* | 12/2020 | Jeong | A45D 33/006 |
| 2020/0397121 | A1* | 12/2020 | Lee | A45D 33/006 |
| 2021/0120937 | A1* | 4/2021 | Lee | A45D 33/20 |
| 2021/0267350 | A1* | 9/2021 | Carraro | A45D 40/0068 |
| 2022/0031043 | A1* | 2/2022 | Kim | A45D 40/221 |

FOREIGN PATENT DOCUMENTS

| | | | |
|---|---|---|---|
| JP | 3676461 | B2 | 7/2005 |
| JP | 3838703 | B2 | 10/2006 |
| JP | 3927872 | B2 | 6/2007 |
| JP | 4061402 | B2 | 3/2008 |
| JP | 4207183 | B2 | 1/2009 |
| KR | 20-0442887 | Y1 | 12/2008 |
| KR | 20-2009-0009484 | U | 9/2009 |
| KR | 20-2011-0007756 | U | 8/2011 |
| KR | 20-2013-0007248 | U | 12/2013 |
| KR | 20-0477739 | Y1 | 7/2015 |
| KR | 10-1584512 | B1 | 1/2016 |
| KR | 10-2016-0070273 | A | 6/2016 |
| KR | 10-2016-0146215 | A | 12/2016 |
| KR | 10-2017-0019202 | A | 2/2017 |
| KR | 10-2017-0091194 | A | 8/2017 |
| KR | 10-1765685 | B1 | 8/2017 |
| KR | 10-2017-0118595 | A | 10/2017 |
| KR | 10-2018-0021347 | A | 3/2018 |
| KR | 10-2018-0091138 | A | 8/2018 |
| KR | 10-1906821 | B1 | 10/2018 |

* cited by examiner

COSMETIC CONTAINER

CROSS-REFERENCE TO RELATED APPLICATION

The present application claims priority under 35 U.S.C. § 119(a) to Korean patent application number 10-2019-0109631 filed on Sep. 4, 2019 in the Korean Intellectual Property Office, the entire disclosure of which is incorporated herein by reference.

BACKGROUND

1. Technical Field

Various embodiments of the present disclosure generally relate to a cosmetic container, and more particularly, to a cosmetic container, which has an improved opening and closing structure, thus improving convenience of use.

2. Related Art

Generally, cosmetics, such as foundation or sun block, which are widely used, are utilized to realize the effects of protecting the skin, making a person look more attractive, and reducing wrinkles. A user may use a method of absorbing cosmetics in a puff and then applying the cosmetics to the skin. A cosmetic container that accommodates the cosmetics and the puff may be commonly referred to as a compact type cosmetic container.

That is, the compact type cosmetic container may be sold with a makeup tool such as the puff as well as the cosmetics being accommodated therein. Therefore, in order to use the cosmetics, a user opens a lid to take the puff out from the cosmetic container. Then, the user makes the puff come into contact with the cosmetics with the user's finger being fitted into an elastic strap or the like provided on the puff to apply a predetermined amount of cosmetics to the puff.

The compact type cosmetic container usually includes a main body that accommodates the cosmetics, and a cover that covers the main body. Further, as disclosed in Korean Patent No. 10-1906821, a hinge structure is provided on a rear surface of the main body to couple the main body to the cover, and an opening and closing means (locker) including a button is provided on an opposite side of the hinge structure, thus obtaining an opening and closing structure.

Such a structure is used from the past to the present.

SUMMARY

Various embodiments of the present disclosure are directed to a cosmetic container, which is improved in a hinge structure and an opening and closing structure, thus securing an additional space and improving convenience of use.

An embodiment of the present disclosure may provide for a cosmetic container including a main body configured to store cosmetics therein; a cover configured to open and close a first side of the main body; and a hinge part configured to hingedly connect the cover to the main body, wherein the hinge part may include a shaft insert part protruding from an upper end of the main body, with a hinge shaft being inserted into the shaft insert part; and a shaft coupling part depressed in the cover to be at a position corresponding to the shaft insert part, and securing both ends of the hinge shaft.

The main body and the cover may be magnetically coupled to each other on an opposite side of the hinge.

The main body may include a support groove that is concavely formed from the first side of the main body to a second side thereof.

The support groove may be formed to correspond to a rear end of the cover, so that the cover may maintain an angle from 110 degrees to 130 degrees with the main body in a state where the cover is rotated to open an interior of the main body.

When the cover is opened, an edge of an upper surface of the cover may come into contact with an end of the support groove. The hinge part may include an inclined surface that is inclined towards a front in a direction from top to bottom, so that the rear end of the cover may guide or may not interfere with the cover along an opening course.

A lower end of the hinge part extending from the main body may be provided in front of the support groove.

The cosmetic container may further include an applicator detachably provided on a lower portion of the main body.

The cosmetic container may further include a band coupled to a central portion of an outside of the main body, or coupled to a front portion or a rear portion that is eccentric from the central portion, and rotatably provided, so that the band may be in contact with a side of the main body, or may be rotated to form a space from a bottom surface of the main body.

The cosmetic container may further include a storage container defining a receiving space to store the cosmetics therein, and including a lid that is hingedly coupled to open or close the receiving space. The main body may include a receiving depression to receive a hinge coupling structure of the storage container.

The receiving depression may be a pair of receiving depressions provided on left and right sides of the main body, respectively, thus allowing a position of the hinge coupling structure of the storage container to be optionally changed.

The storage container may include a hinge part hingedly coupling the lid thereto, and received in any one of the receiving depressions provided in the main body; and a protrusion received in the remaining one of the receiving depressions provided in the main body.

The main body may be formed to be penetrated from top to bottom, and may include a first thread formed on an inner circumference thereof, and the cosmetic container may further include a storage container that includes a second thread formed on an outer circumference thereof to engage with the first thread, so that the storage container may be coupled to the main body, thus defining a receiving space to store the cosmetics therein.

The cosmetic container may further include a storage container defining a receiving space to store the cosmetics therein, and protruding downwards from the main body to form a step with respect to the main body; and an auxiliary container having at least one auxiliary space, and detachably provided on the step of the storage container.

The auxiliary container may be coupled to the storage container by fitting, and may include an auxiliary lid provided on a top of the auxiliary container to open or close the auxiliary space.

Either of the storage container or the main body may include a first magnet, and the auxiliary container may include metal or a second magnet that is magnetically coupled to the first magnet, so that the auxiliary container may be magnetically coupled to either of the storage container or the main body.

The auxiliary container may have a shape of a ring surrounding an outside of the storage container, and may be magnetically coupled at an upper end thereof to the main body. The main body may include the first magnet that is interiorly provided on the opposite side of the hinge part, so that a lower portion of the first magnet may be magnetically coupled to the auxiliary container, and an upper portion of the first magnet may be magnetically coupled to the cover.

DETAILED DESCRIPTION

Figure 1:
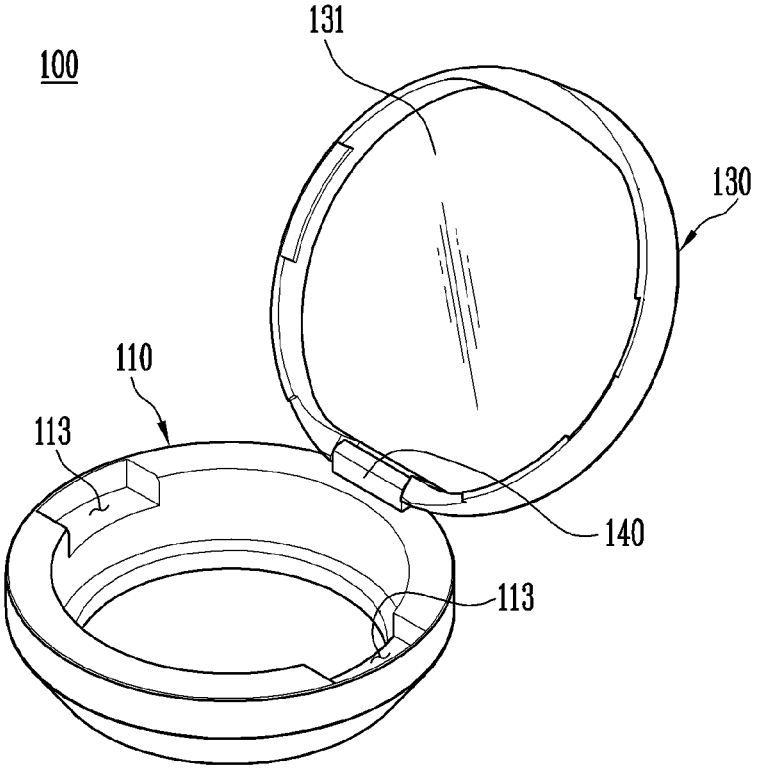
FIG. 1 is a perspective view illustrating a state in which a cover of a cosmetic container in accordance with an embodiment of the present disclosure is opened.

The above and other objects, advantages, and features of the present disclosure will be more clearly understood from the following detailed description when taken in conjunction with the accompanying drawings. In the present specification, it should be noted that the same reference numerals are used to denote the same components throughout different drawings. In the following description, the detailed description of known functions and configurations that may unnecessarily obscure the subject matter of the present disclosure will be omitted.

Hereinafter, preferred embodiments of the present disclosure will be described in detail with reference to the accompanying drawings.

Figure 9:
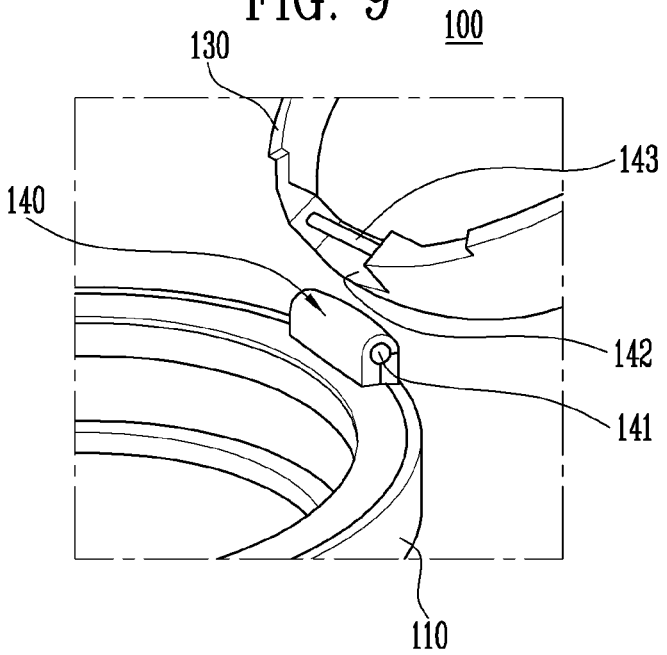
FIG. 9 is a diagram illustrating a state in which the hinge part of FIG. 8 is separated.
Figure 10:
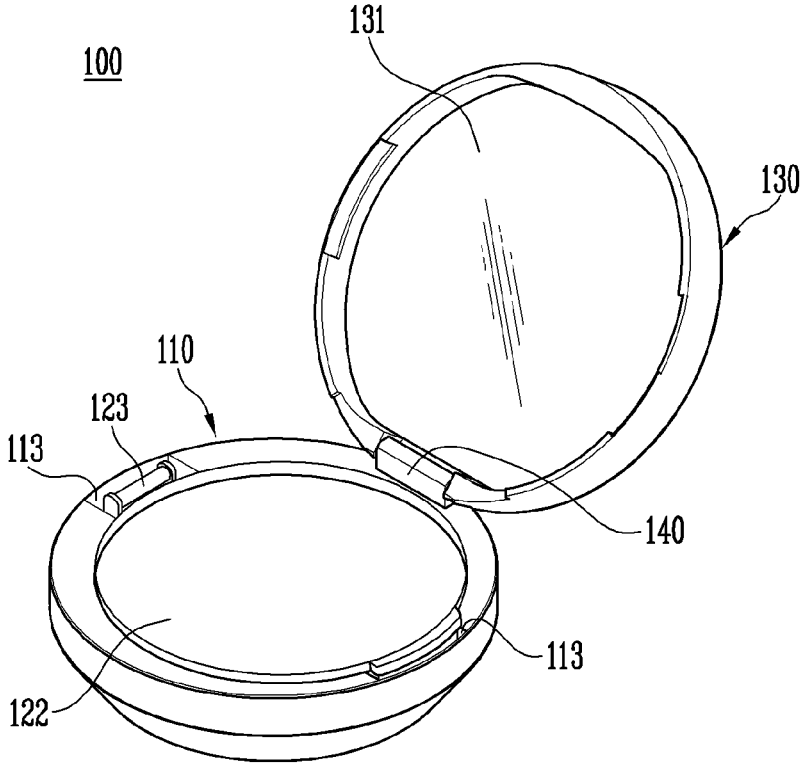
FIG. 10 is a diagram illustrating a state in which a storage container of the cosmetic container in accordance with an embodiment of the present disclosure is closed.
Figure 11:
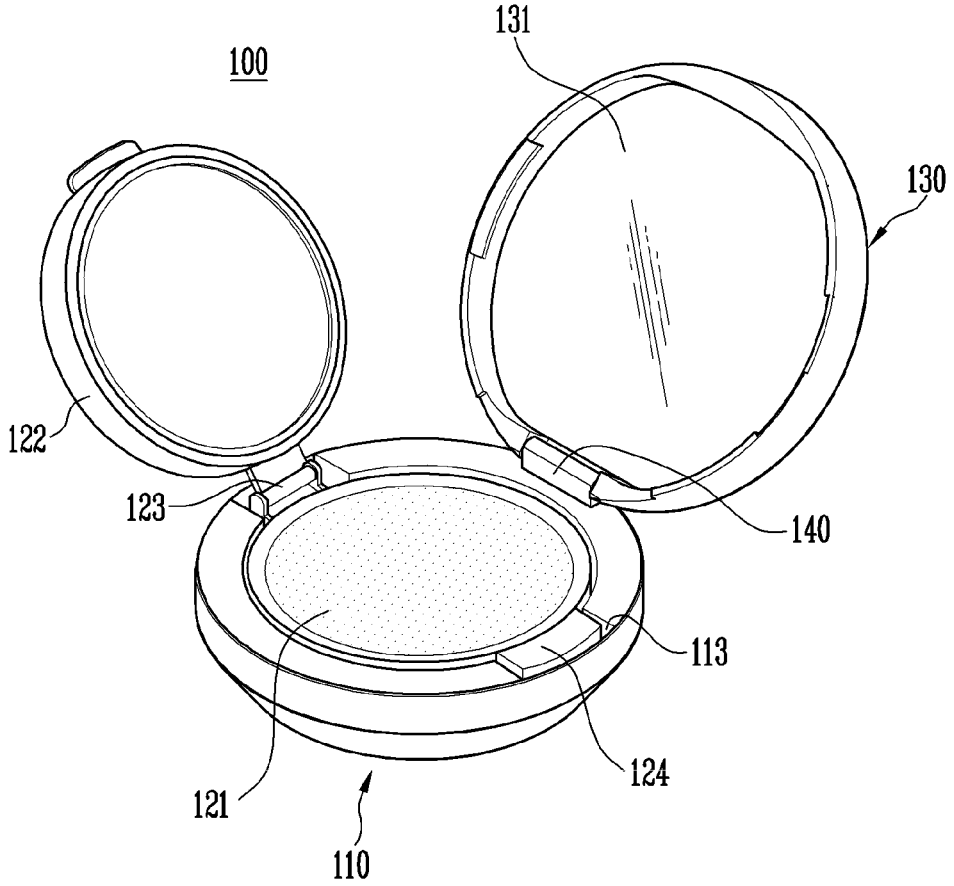
FIG. 11 is a diagram illustrating a state in which the storage container of the cosmetic container in accordance with an embodiment of the present disclosure is opened.

FIGS. 1 to 5 are diagrams illustrating a cosmetic container in accordance with an embodiment of the present disclosure, FIGS. 6A and 6B to FIG. 9 are diagrams illustrating a hinge part of the cosmetic container in accordance with an embodiment of the present disclosure, and FIGS. 10 and 11 are diagrams illustrating a storage container of the cosmetic container in accordance with an embodiment of the present disclosure.

Figure 12:
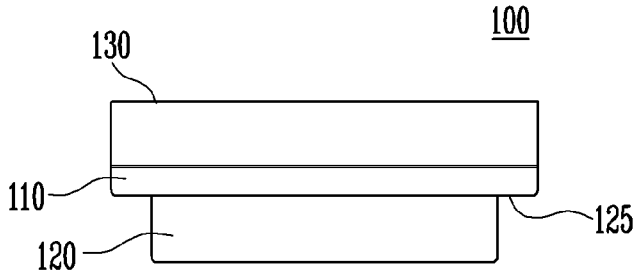
FIG. 12 is a diagram conceptually illustrating a state in which the main body and the storage container of the cosmetic container in accordance with an embodiment of the present disclosure are coupled to each other.
Figure 13:
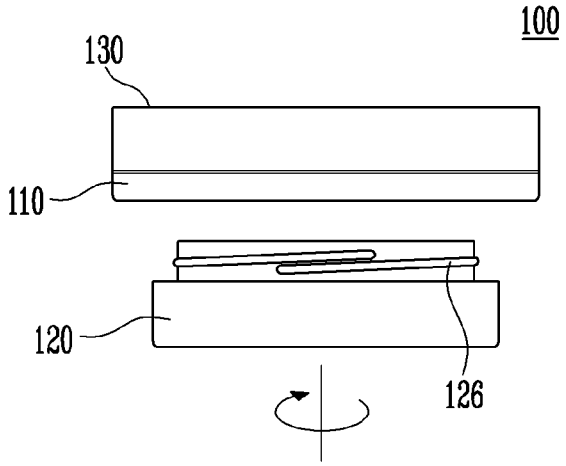
FIG. 13 is a diagram illustrating a state in which the main body and the storage container of FIG. 12 are separated from each other.
Figure 14:
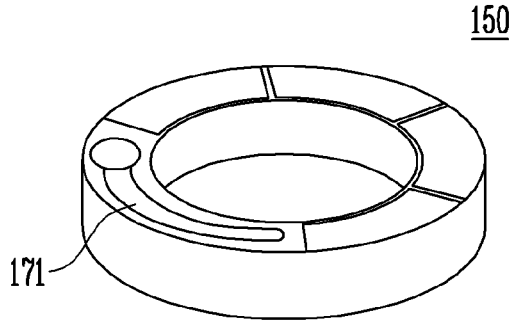
FIG. 14 is a diagram conceptually illustrating an auxiliary container of the cosmetic container in accordance with an embodiment of the present disclosure.

Furthermore, FIGS. 12 and 13 are diagrams illustrating a coupling relationship between a main body and a storage container of the cosmetic container in accordance with an embodiment of the present disclosure, and FIG. 14 is a diagram illustrating an auxiliary container of the cosmetic container in accordance with an embodiment of the present disclosure.

Figure 15:
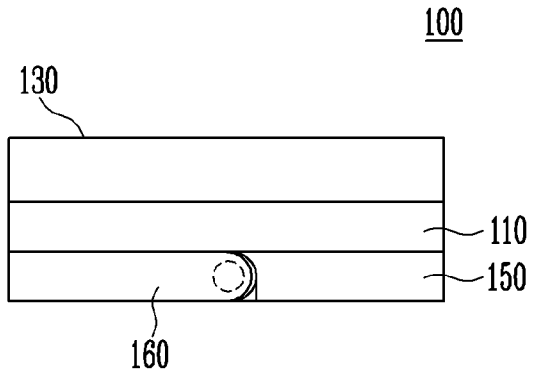
FIG. 15 is a diagram conceptually illustrating a state in which a band is provided on the cosmetic container in accordance with an embodiment of the present disclosure.
Figure 16:
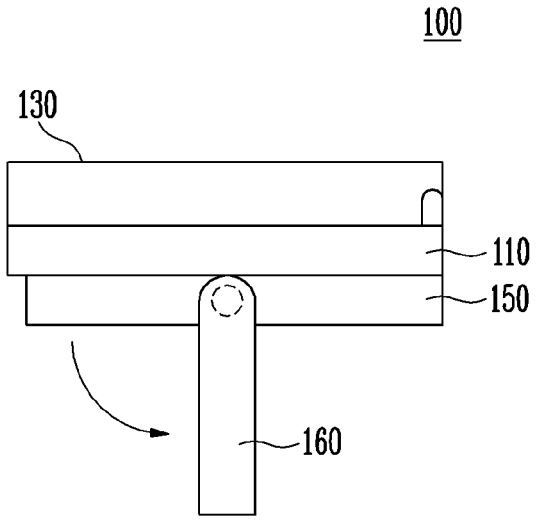
FIG. 16 is a diagram illustrating a state in which the band of FIG. 15 is rotated.
Figure 17:
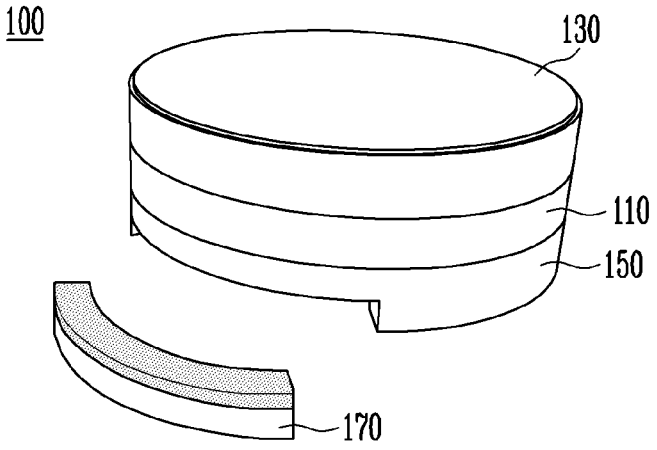
FIG. 17 is a diagram illustrating a state in which an applicator is separated from the cosmetic container in accordance with an embodiment of the present disclosure.
Figure 18:
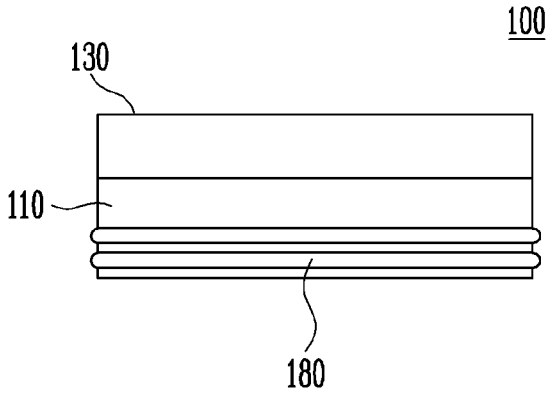
FIG. 18 is a diagram conceptually illustrating a state in which a hair band is mounted on the cosmetic container in accordance with an embodiment of the present disclosure.

Moreover, FIGS. 15 and 16 are diagrams illustrating a band provided on the cosmetic container in accordance with an embodiment of the present disclosure, FIG. 17 is a diagram illustrating an applicator of the cosmetic container in accordance with an embodiment of the present disclosure, and FIG. 18 is a diagram conceptually illustrating a state in which a hair band is mounted on the cosmetic container in accordance with an embodiment of the present disclosure.

Referring to FIGS. 1 to 18, a cosmetic container 100 in accordance with an embodiment of the present disclosure may include a main body 110, a storage container 120, a cover 130, a hinge part 140, an auxiliary container 150, a band 160, and an applicator 170.

The main body 110 may define the appearance of a lower portion of the cosmetic container 100, may be magnetically coupled to a cover 130 on an opposite side of the hinge part 140, and may store cosmetics therein. For example, the storage container 120 in which the cosmetics are directly accommodated or stored may be provided to store the cosmetics, and a support groove 111 may be formed. According to an embodiment/modification, a first magnet 112 may be provided in the main body, and a first thread (not shown) and a receiving depression 113 may be formed on the main body.

For example, when the main body 110 directly accommodates the cosmetics, the main body 110 may have a top-open container structure that is opened at a top thereof and closed at a bottom thereof. Even when the storage container 120 is accommodated in the main body 110, the main body 110 may have the top-open container structure. However, when the storage container 120 is separately accommodated in the main body 110, in order to reduce the entire thickness of the cosmetic container 100, namely, to prevent a thickness from being increased by a bottom surface of the main body 110, the main body 110 may have a top and bottom open container structure that is penetrated from top to bottom.

Here, cosmetics may be liquid cosmetics, for example, facial cosmetics covering the user's facial skin, such as foundation or sun block, or body cosmetics, such as body sun block. However, the viscosity and kind of the cosmetics are not limited thereto. The cosmetics stored in the main body 110 may have various types including compressed powder, such as solid powder, or liquid materials having high viscosity, so that the cosmetics are not limited to specific cosmetics. In addition, the cosmetics may be applied to a tool such as a puff (not shown) (the tool may be stored in a lid of the storage container 120 that will be described below) or a separate applicator 170 or 171 that will be described below, and then transferred to a user's face.

Moreover, as illustrated in FIGS. 3 to 6, the support groove 111 of the main body 110 may be formed in a first side (upper surface) of the main body 110 to be concave towards a second side. For example, the support groove 111 may correspond to a rear end of the cover 130 to maintain an angle from 110 degrees to 130 degrees with the main body 110 in a state where the cover 130 is rotated to open the interior of the main body 110. Thus, when the cover 130 has a circular shape, the support groove 111 may be formed as a curved concave groove (see FIG. 3).

In other words, the cover 130 does not interfere with the main body 110 at the top of the main body 110, thus allowing the cover to be completely tilted back. Or, the cover interferes with the flat upper surface of the main body 110, thus preventing the cover from being erected at an angle of 90 degrees with the main body 110. Thus, the cover 130 may be supported at the angle ranging from 110 to 130 degrees that are easy for a user to see the mirror 131.

This may be realized in the following manner: while the cover 130 pivoting about the main body 110 is tilted at a predetermined angle (110 degrees to 130 degrees) through a concave area of the support groove 111 relative to a structure of the main body 110 that comes into contact with the support groove 111 formed in an end of the main body 110 to be flat, namely, the cover 130 is tilted at an angle that is larger than 90 degrees by an inclined section of the support groove 111, a surface of the support groove 111 may form a support surface of the cover 130.

Therefore, when the cover 130 is opened, an edge of the upper surface of the cover 130 may come into contact with an end of the support groove 111 (see FIGS. 2, 5, 7, and 8, FIG. 5 shows the support groove in a state where the cover 130 is not completely tilted), so that the cover 130 may be erected at an obtuse angle relative to the main body 110 by the support groove 111 that is in the form of the concave groove and has an inclination.

As such, when the cover 130 is hingedly connected by the hinge part 140 that is provided on the main body 110, the cover 130 may be erected at an angle that is similar to 90 degrees due to interference of a flat surface of the main body 110 or the cover 130 may be erected while not being completely tilted from the main body 110 so as not to interfere with the main body 110 if there is no support groove 111. However, according to this embodiment, the mirror 131 of the cover 130 may be maintained by the support groove 111 so that it is easy for a user to see the mirror.

The first magnet 112 of the main body 110 may be magnetically coupled to the cover 130 and/or the auxiliary container 150. For example, referring to FIGS. 2A and 2B, the first magnet 112 may be provided on an opposite side of the hinge part 140 to vertically generate a magnetic force in the main body 110, so that an upper portion of the first magnet 112 may be magnetically coupled to the cover 130. In the case of having the auxiliary container 150, a lower portion of the first magnet 112 may be magnetically coupled to the auxiliary container 150.

Hereinafter, a structure where the storage container 120 is accommodated in the main body 110 (at least a portion thereof may be accommodated, so that the lower portion of the storage container 120 may be exposed) will be described as an example. However, as described above, various modifications are possible; for example, the cosmetics may be directly accommodated in the main body 110. Furthermore, as an example where the storage container 120 is provided on the main body 110, a first thread (not shown) may be formed on the main body 110.

The first thread of the main body 110 may be provided such that the storage container 120 is fastened to the main body 110 in a screw-type fastening method. For example, the first thread may be formed on an inner circumference of the main body 110, and a second thread 126 may be formed on an outer circumference of the storage container 120, so that the storage container 120 may be coupled to the main body 110 (see FIGS. 12 and 13).

Of course, the coupling of the storage container 120 may be implemented by various modifications and known technologies, including a screw-type fastening method, an interference-fit method, a protrusion locking method, etc.

Furthermore, the storage container 120 accommodated in the main body 110 may be made of a metal cushion. However, when the storage container has the structure of a sponge cushion, the lid (not shown) may be provided, so that the main body 110 may have the receiving depression 113 in which the hinge-coupling structure of the storage container 120 is received.

Here, referring to FIG. 1, the receiving depression 113 may be provided in a direction deviating from the hinge part 140, for example, provided at a position spaced apart from the hinge part 140 by 90 degrees. The position of the receiving depression 113 may be provided on the left while being spaced apart from the hinge part 140 by 90 degrees and/or provided on the right while being spaced apart from the hinge part 140 by 90 degrees (the receiving depressions may be provided on the left and right sides of the main body 110).

Particularly, when a pair of receiving depressions 113 is provided on the left and right sides of the main body 110, a user may optionally change the hinge coupling structure of the storage container 120. Thus, when a right-handed person as well as a left-handed person puts on make-up while holding a tool such as a puff with the left hand and holding the cosmetic container 100 with the right hand, such a structure prevents the lid from interfering with an operation in which the cosmetics are transferred through the tool from the cosmetic container 100. Moreover, after the make-up is completed, it is possible to hold the cosmetic container 100 with one hand and simultaneously close the lid by pushing the lid with the thumb of the hand holding the main body 110.

The storage container 120 may have a receiving space in which the cosmetics are stored. Various structures such as sponge cushion or metal cushion may be applied to the storage container. In the case where the cosmetics are directly received in the main body 110, the storage container may be omitted. As such, various modifications are possible.

Meanwhile, when the cosmetics are liquid, there may occur a problem that the cosmetics are easily spilled through an opening of a large area or the cover 130 is stained with the cosmetics. It is preferable to store the cosmetics in a space which is sealed to minimize contact with the air and thereby prevent the cosmetics from being deteriorated. Thus, hereinafter, an example having the storage container 120 will be described.

For example, when the storage container 120 is the sponge cushion, a depression 121 may be formed in the storage container 120 to define a receiving space in which the cosmetics are received. The depression 121 may have a structure that is concavely formed from top to bottom, and the top of the depression 121 may be open to be opened or closed by the lid 122. Here, the depression 121 may be formed such that the cosmetics are directly exposed to an outside when the lid 122 is opened.

The storage container 120 may be provided with the lid 122 that is hingedly coupled to open or close the receiving space. The hinge coupling direction of the lid 122 may different from the hinge coupling direction of the cover 130, so that the lid 122 does not hide the mirror 131 of the cover 130 even when the lid is opened, thus making it easy to use the mirror 131.

Furthermore, unlike the related art where the lid of the cosmetic container is opened only in the left direction, according to this embodiment, the lid may be opened in the right direction as described above. Here, the storage container 120 may be opened in the right direction by the receiving depression 113 of the above-mentioned main body 110.

That is, referring to FIGS. 10 and 11, the storage container 120 is configured such that the depression 121 and the lid 122 are connected by a hinge 123. When the storage container 120 is seated in the main body 110, the hinge 123 may be received in either of the receiving depressions 113 provided on the left and right sides of the main body 110, so that the opening and closing directions of the lid 122 may be optionally used in at least two directions.

Moreover, a protrusion 124 is provided on the storage container 120 to be opposite to the hinge 123. At least two receiving depressions 113 may be provided on the left and right sides of the main body 110. When the hinge 123 is received in any one of the receiving depressions 113, the storage container 120 may be provided with the protrusion 124 that is inserted into the other receiving depression 113.

Thus, even if the storage container 120 having one hinge 123 is seated in the main body 110 having a plurality of receiving depressions 113, all of the receiving depressions 113 are filled, thus eliminating an empty space and improving appearance.

In this case, the protrusion 124 may have a shape and a size corresponding to those of the receiving depression 113, and may have a fine gap between the protrusion and the receiving depression 113 so that the protrusion is smoothly inserted into the receiving depression 113.

Meanwhile, when the storage container 120 has the metal cushion structure as described above, the lid 122 may be omitted and a discharge plate (not shown) may be provided on the depression 121, so that a small amount of contents may be discharged by a user's operation. The discharge plate may be used as a palette. As such, the structure for storing contents may be variously made, and an operating mechanism thereof is known to those skilled in the art, so that a detailed description thereof will be omitted herein.

Referring to FIGS. 12, such a storage container 120 may protrude downwards from the main body 110, so that a step 125 may be formed with respect to the main body 110.

For example, when the first thread is formed on the inner circumference of the main body 110, a second thread 126 may be formed on the outer circumference of the storage container 120 to engage with the first thread, so that the storage container may be coupled to the main body 110. Since a space may be formed in the step 125 between the main body 110 and the storage container 120, at least one of the auxiliary container 150, the band 160, and the applicator 170 may be fastened using a magnetic-force coupling method, a hinge coupling method, etc.

The cover 130 may open or close the first side (upper surface) of the main body 110. Referring to FIG. 1, one side of the cover may be hingedly coupled by the hinge part 140, and the other side may be magnetically coupled.

Here, the magnetic coupling may be realized by providing the second magnet 132 or metal on an opposite side of the hinge part 140, that is, a position facing the first magnet 112 of the main body 110.

Therefore, unlike the conventional opening and closing structure such as a button structure, a spring, a button, and an additional space for operating the button are not required, so that a structure may be simplified. The simple structure may lead to a reduction in manufacturing cost and man hour for forming the opening and closing structure, and may reduce the size of the cosmetic container 100, thus making the cosmetic container 100 more compact. Further, an internal space may be enlarged, and at least one of the auxiliary container 150, the band 160, and the applicator 170 may be easily coupled to the lower portion of the main body 110, as described above.

In addition, unlike the related art where the hinge structure is located on a rear side of the main body to be interfered by the bottom surface of the cover structure or a user's finger when the cover structure is opened and the lower portion of the mirror is hidden by the hinge structure, the cover 130 of this embodiment may be configured such that the cover 130 may be pivoted on the top of the main body 110, the support groove 111 may form an opening angle at which a user may easily see the mirror 131, and the mirror may not be hidden by the hinge structure, thus improving a user's convenience. This will be described in detail in the following description of the hinge part 140.

That is, as will be described later, this embodiment adopts a structure where the hinge part 140 is provided with the shaft insert part 141 protruding from the upper end of the main body 110, and is an inverse structure as compared with the related art. Here, this embodiment also employs the magnetic open-and-close structure that has been described prior to the hinge part 140 of the inverse structure, thus maximizing the compactness of the cosmetic container 100.

Referring to FIGS. 6 to 9, the hinge part 140 may hingedly connect the cover 130 to the main body 110, with an inclined surface 141A formed on the hinge. The hinge part may have the shaft insert part 141, a shaft coupling part 142, and a hinge shaft 143. The hinge part 140 may be provided such that a lower end extending from the main body 110 is located in front of the support groove 111, and consequently the hinge part 140 may not protrude outwards from the cover 130. Thus, referring to FIGS. 3 and 15, the entire cosmetic container 100 has no structure protruding outwards, so that the appearance of the container may not be deteriorated.

Moreover, the shaft insert part 141 of the hinge part 140 is a configuration for connecting the hinge shaft 143 thereto, so that the hinge shaft 143 may be inserted into the shaft insert part. Unlike the related art where the hinge structure is connected to the rear surface of the main body, the shaft insert part protrudes from the upper end of the main body 110, so that the stability of support to the bottom surface may be improved. The inclined surface 141A may be formed on the shaft insert part.

In other words, the conventional hinge structure is provided on the rear surface of the main body that is the opposite side of the button. When the cover is opened, the hinge structure is opened from the rear side of the main body to be interfered by a user's finger holding the main body, so that the finger is pushed back by the rotation of the hinge structure. Consequently, it is unstable to hold the cosmetic container. Further, since the hinge structure protrudes from the bottom surface when rotating from the rear surface of the main body, the main body floats from the bottom surface and the hinge structure is supported to come into contact with the bottom surface. Thus, since the main body is not supported by the entire lower surface of the main body, namely, the main body is supported at two points, such as the front of the main body and the protruding portion of the hinge structure, the main body may be easily shaken.

However, according to this embodiment, the shaft insert part 141 protrudes from the upper end of the main body 110, so that the hinge structure does not protrude from both the rear surface of the main body 110 and the bottom surface. Thus, even if the cosmetic container 100 is put on the bottom surface with the cover 130 being opened, the cosmetic container 100 may be stably supported without shaking.

Moreover, since the hinge structure is not formed on the rear surface of the main body 110 and a rotating point is not pushed backwards, the cover 130 may be opened at a front thereof compared to the conventional structure. The mirror 131 may be positioned closer to the front as compared to the conventional structure. Of course, since the mirror 131 is not hidden by the hinge structure, it may be easier for a user to see the mirror, in other words, visibility may be improved.

Figure 6A:
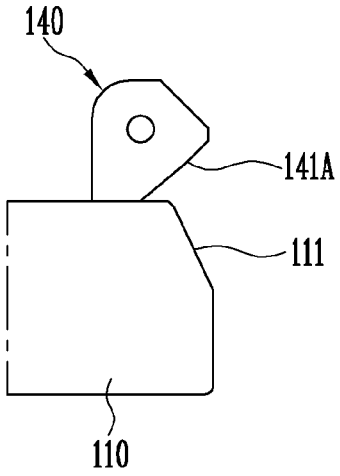
FIG. 6A is a diagram illustrating an inclined surface of a hinge part and a support groove of the cosmetic container in accordance with an embodiment of the present disclosure.
Figure 6B:
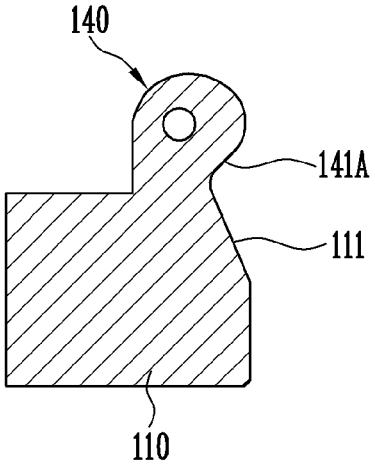
FIG. 6B is a sectional view illustrating a main body and a shaft insert part of the cosmetic container in accordance with an embodiment of the present disclosure.
Figure 7:
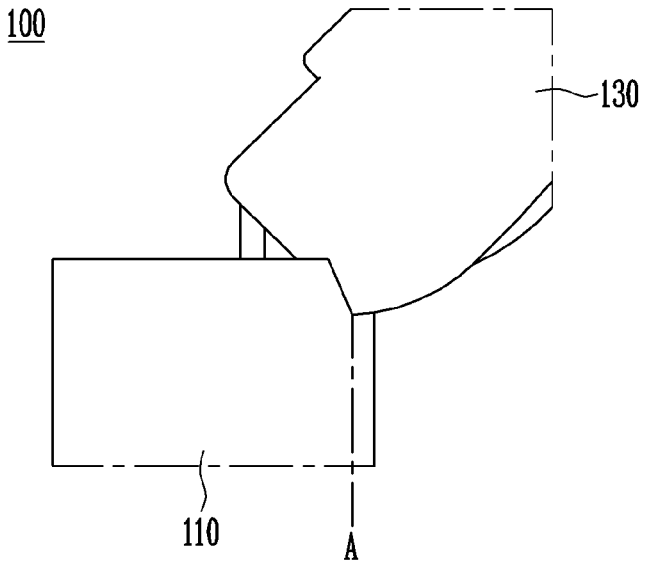
FIG. 7 is a partially enlarged view illustrating the main body and the cover that are connected by the hinge part of the cosmetic container in accordance with an embodiment of the present disclosure.
Figure 8:
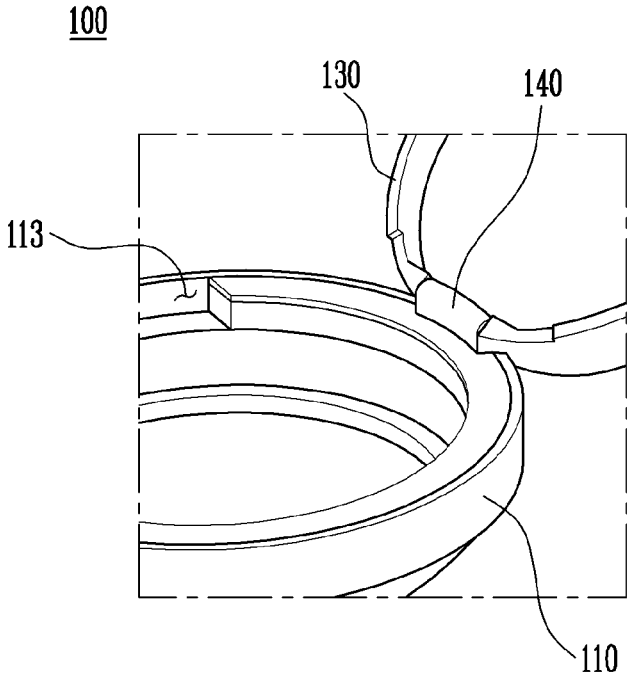
FIG. 8 is a diagram illustrating the hinge part of the cosmetic container in accordance with an embodiment of the present disclosure.

In addition, referring to FIGS. 6A and 6B and FIG. 7, when the cover 130 is opened, the edge of the upper surface of the cover 130 may be in contact with an end (see portion A of FIG. 7) of the support groove 111. The inclined surface 141A of the shaft insert part 141 may be inclined towards the front in a direction from the top to the bottom. Thus, when the rear end of the cover 130 is rotated along an opening course, the inclined surface 141A of the shaft insert part 141 may guide or may not interfere with the cover 130.

Referring to FIG. 9, the shaft coupling part 142 is a groove structure in which the hinge shaft 143 is provided. The shaft coupling part may be depressed in a position on the cover 130 corresponding to the shaft insert part 141, and the inner circumference of the groove may secure both ends of the hinge shaft 143.

Particularly, according to the related art, a hinge pin is separately manufactured and then fitted, so that the hinge pin is exposed to the outside, thus deteriorating the appearance. In contrast, according to this embodiment, when the hinge shaft 143 is provided in the groove structure of the shaft coupling part 142, namely, when the cover 130 is manufactured, the hinge shaft 143 may be integrally formed. Both ends of the hinge shaft 143 are not exposed to the outside by the shaft coupling part 142, and the circumference of the hinge shaft 143 is inserted into the shaft insert part 141, thus improving the appearance.

Figure 3:
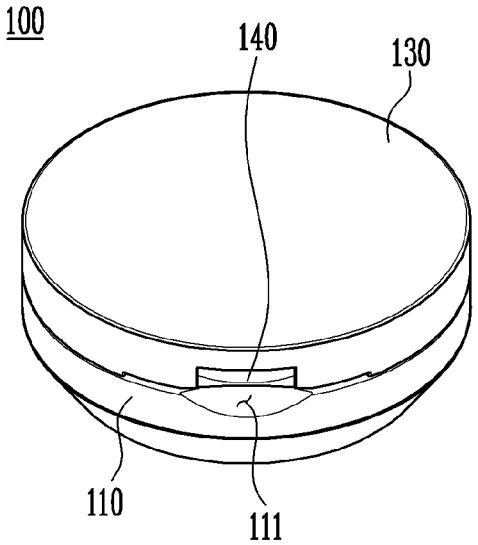
FIG. 3 is a rear view illustrating the cosmetic container in accordance with an embodiment of the present disclosure.
Figure 4:
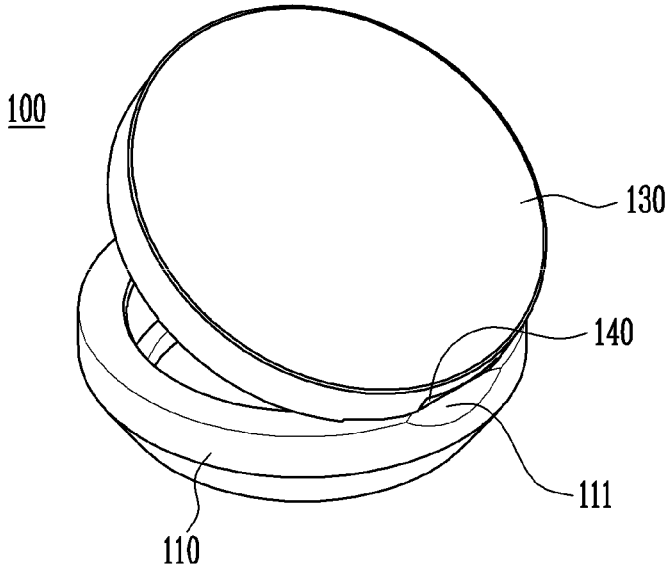
FIGS. 4 and 5 are diagrams illustrating a state in which a cover of FIG. 3 is opened.
Figure 5:
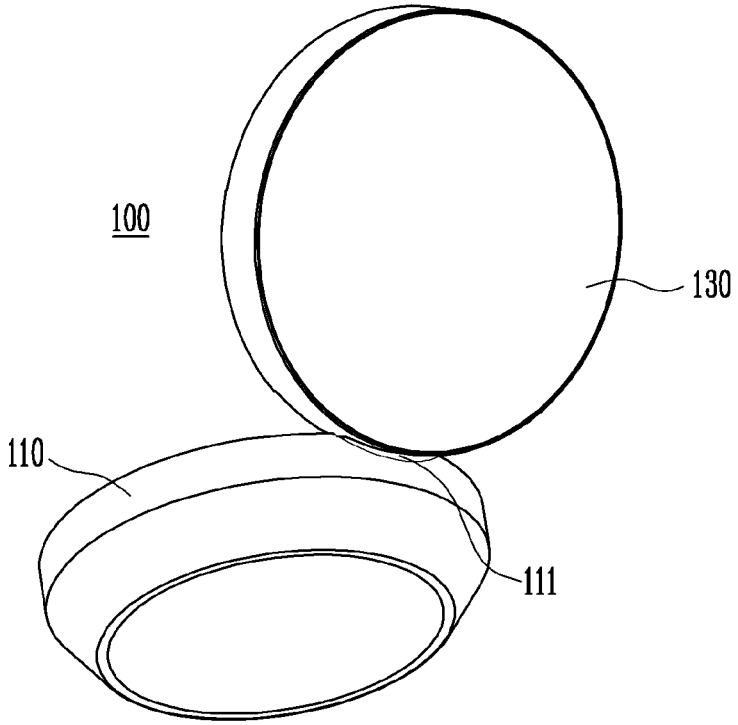

That is, referring to FIG. 3, a conventional hole structure for inserting the hinge pin may be omitted from the cover 130. Of course, referring to FIG. 2B, the exposure of the hinge part 140 may be minimized by the cover 130, thus improving the appearance.

Figure 2A:
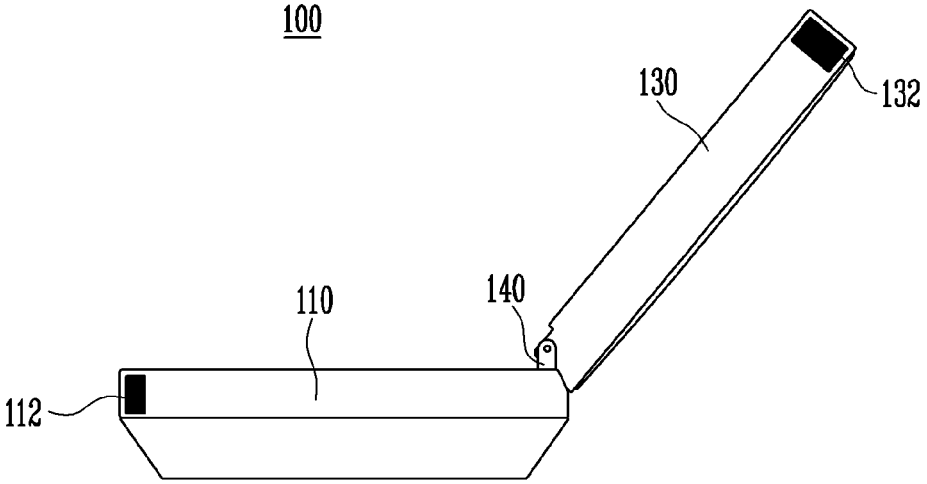
FIG. 2A is a side view conceptually illustrating the state in which the cover of the cosmetic container in accordance with an embodiment of the present disclosure is opened.
Figure 2B:
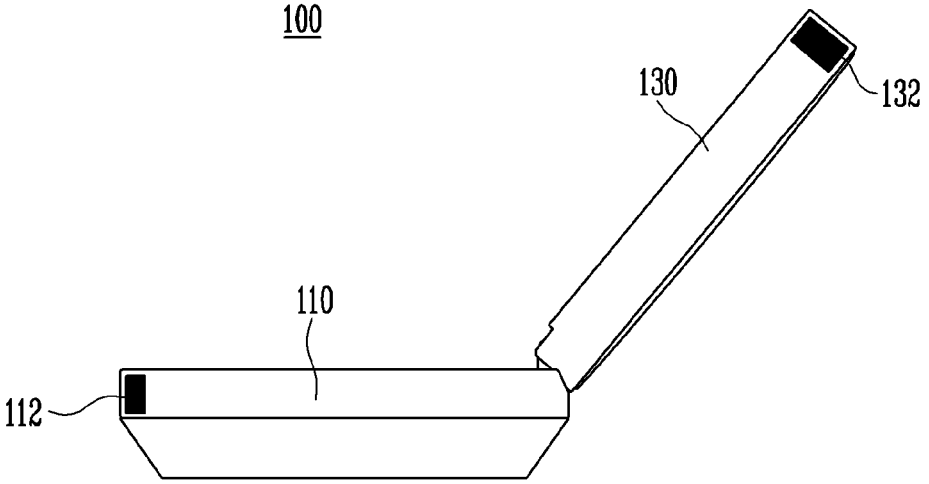
FIG. 2B is a diagram conceptually illustrating another type of hinge part in the cosmetic container in accordance with an embodiment of the present disclosure.

The structure of the hinge part 140 according to this embodiment may be preferable. However, without being limited thereto, the related art may be applied and other modifications are possible. Thus, while having a shape opposite to a shape where the shaft insert part 141 is inserted into the shaft coupling part 142, it is possible to have a structure where the hinge shaft 143 is inserted into the shaft coupling part 142. The structure of FIG. 2A is also possible.

Furthermore, when the hinge shaft 143 is formed integrally with the cover 130 on which the shaft coupling part 142 is formed, the shaft insert part 141 protruding from the upper end of the main body 110 may be provided by separately manufacturing upper and lower parts with respect to the hinge shaft 143 and then assembling the upper and lower parts. Of course, the present disclosure is not limited thereto.

Referring to FIG. 14, the auxiliary container 150 may have one or more auxiliary spaces, so that an auxiliary applicator 171 and/or separate cosmetics (color cosmetics, etc.) may be stored therein. The auxiliary container 150 may have the shape of a ring surrounding the outside of the storage container 120. When the step 125 is formed between the main body 110 and the storage container 120, the auxiliary container 150 may be detachably provided on the step 125 formed on the outside of the storage container 120.

Since the auxiliary container 150 may be mounted using additional space that is formed in the rear surface of the main body 110 and in front of the main body 110 as compared with the conventional structure, the auxiliary container 150 may be added without increasing the size of the conventional compact-type cosmetic container.

For example, the coupling of the auxiliary container 150 may be detachably provided to be simply fitted into the step 125, and may be achieved by forming the thread. Alternatively, the auxiliary container 150 may be magnetically coupled. As described above, the above-mentioned first magnet 112 may be provided on the outer circumference (or inside) of the storage container 120 or the main body 110, and the auxiliary container 150 may include metal or a second magnet (it may be provided separately from the above-mentioned reference number 132) that is magnetically coupled to the first magnet, so that the auxiliary container 150 may be magnetically coupled to one of the storage container 120 and the main body 110.

To be more specific, in the case of including the magnet equal/similar to the first magnet in the storage container 120, the magnet may be provided along any one area or an entire area of the outer circumference of the storage container 120 protruding from the main body 110. Here, the auxiliary container 150 has on the inner circumference thereof a magnet equal/similar to the metal or the second magnet 132, so that the auxiliary container 150 may be magnetically coupled to the storage container 120.

Meanwhile, in the case of including the first magnet 112 in the main body 110, an upper end of the auxiliary container 150 may be magnetically coupled to the main body 110. As described above, the metal provided on the upper end of the auxiliary container 150 or the magnet equal/similar to the second magnet 132 may be magnetically coupled to the lower portion of the first magnet 112 that is interiorly provided on the opposite side of the hinge part 140. Here, the opposite side of the first magnet 112, namely, the hinge part 140 may include a magnet to be magnetically coupled to the auxiliary container 150, or a magnet may be provided on a lower side of the hinge part 140 in the main body 110 to be magnetically coupled to the auxiliary container (magnetically coupled at two points, namely, front and rear points).

Alternatively, an individual hinge structure that is symmetrical with the hinge part 140 may be provided under the hinge part 140, the auxiliary container 150 may be hingedly connected to such a hinge structure (one-point magnetic coupling and hinge coupling), and a separate auxiliary lid may be provided. As such, various modifications are possible.

The band 160 may be coupled to the central portion of the outside of the main body 110, or be coupled to a front portion or a rear portion that is eccentric from the central portion, and be rotatably provided. Thus, the band may be in contact with the side of the main body 110, or be rotated to form a space from the bottom surface of the main body 110. In this case, a user's hand is caught by the space, so that the cosmetic container 100 is restrained by the user's hand, thus preventing an accident such as a fall.

Meanwhile, since the storage container 120 and/or the auxiliary container 150 may be coupled to the main body 110, the band 160 may be provided on the storage container 120 and/or the auxiliary container 150 in a method equal/similar to the method where the band is coupled to the main body 110. As such, various modifications are possible (see FIGS. 15 and 16).

The applicator 170 may be provided separately from a makeup tool that is stored in the lid of the storage container 120. For example, the applicator may be detachably provided on the lower portion of the main body 110.

As described above, as the button type of open-and-close structure of the main body 110 is omitted, an additional space may be formed in the outer circumference of the main body 110 as compared with the related art. Therefore, it is possible to install the applicator 170 as an additional product without increasing a size as compared with the conventional compact type cosmetic container.

Such an applicator 170 may be provided with a handle structure extending from the main body 110, and a cosmetic transfer structure fixed to the handle structure, such as sponge or brush. The applicator 170 may be coupled to the main body 110 through fitting coupling or magnetic coupling, and the cosmetic transfer structure may be stored so as not to be exposed. However, the present disclosure is not limited thereto.

In addition, reference numeral 180 denotes a hair band, which is detachably provided on the outside of any one of the main body 110, the storage container 120, and the auxiliary container 150, thus improving a user's convenience.

As such, this embodiment makes it easier to see the mirror, and prevents a user's finger from being pushed, thus improving convenience of use.

A cosmetic container according to the present disclosure is improved in a hinge structure and an opening and closing structure, so that it is possible to secure an additional space, thus allowing an additional amount of cosmetics to be added without increasing an entire size, and can form a rotating angle of a cover so that it is easy for a user to see, thus improving convenience.

Although the present disclosure was described with reference to specific embodiments, it is apparent to those skilled in the art that the present disclosure may be changed and modified in various ways without departing from the scope of the present disclosure, which is described in the following claims.

All simple modifications or changes of the present disclosure fall within the purview of the present disclosure, and the specific scope of the present disclosure will be apparent from the following claims.

What is claimed is:

1. A cosmetic container, comprising:

a main body configured to store cosmetics therein;

a cover configured to open and close a first side of the main body;

a hinge part configured to hingedly connect the cover to the main body;

a storage container defining a receiving space to store the cosmetics therein, the storage container protruding downwards from the main body to form a step with respect to the main body; and an auxiliary container having at least one auxiliary space, the auxiliary container being detachably provided on the step of the storage container, wherein the hinge part comprises:

a shaft insert part protruding from an upper end of the main body;

a hinge shaft being inserted into the shaft insert part; and a shaft coupling part formed by depressing an edge of the cover to receive the shaft insert part, and securing both ends of the hinge shaft.

2. The cosmetic container according to claim 1, wherein the main body and the cover are magnetically coupled to each other on an opposite side of the hinge part.

3. The cosmetic container according to claim 1, wherein the main body comprises a support groove that is concavely formed from the first side of the main body to a second side thereof.

4. The cosmetic container according to claim 3, wherein the support groove is formed to correspond to a rear end of the cover, so that the cover maintains an angle from 110 degrees to 130 degrees with the main body in a state where the cover is rotated to open an interior of the main body.

5. The cosmetic container according to claim 3, wherein, when the cover is opened, an edge of an upper surface of the cover comes into contact with an end of the support groove, and wherein the hinge part comprises an inclined surface of which a surface extending from a top to the support groove has a shape that corresponds to a rotating course of the cover, so that a rear end of the cover guides or does not interfere with the cover along an opening course.

6. The cosmetic container according to claim 3, wherein a lower end of the hinge part extending from the main body is provided in front of the support groove.

7. The cosmetic container according to claim 1, further comprising:

an applicator detachably provided on a lower portion of the main body.

8. The cosmetic container according to claim 1, further comprising:

a band coupled to a central portion of an outside of the main body, or coupled to a front portion or a rear portion that is eccentric from the central portion, and rotatably provided, so that the band is in contact with a side of the main body, or is rotated to form a space from a bottom surface of the main body.

9. The cosmetic container according to claim 1, wherein the storage container comprises a lid that is hingedly coupled to open or close the receiving space, and wherein the main body comprises a receiving depression to receive a hinge coupling structure of the storage container.

10. The cosmetic container according to claim 9, wherein the receiving depression comprises a pair of receiving depressions provided on left and right sides of the main body, respectively, thus allowing a position of the hinge coupling structure of the storage container to be optionally changed.

11. The cosmetic container according to claim 10, wherein the storage container comprises:

a hinge hingedly coupling the lid thereto, and received in any one of the receiving depressions provided in the main body; and a protrusion received in the remaining one of the receiving depressions provided in the main body.

12. The cosmetic container according to claim 1, wherein the main body has a top and bottom open structure that is formed to be penetrated from top to bottom, and comprises a first thread formed on an inner circumference of the main body which is opened at the top and the bottom thereof, and wherein the storage container comprises a second thread formed on an outer circumference thereof to engage with the first thread, so that the storage container is coupled to the main body.

13. The cosmetic container according to claim 1, wherein the auxiliary container is coupled to the storage container by fitting, and comprises an auxiliary lid provided on a top of the auxiliary container to open or close the auxiliary space.

14. The cosmetic container according to claim 1, wherein either of the storage container or the main body comprises a first magnet, and wherein the auxiliary container comprises metal or a second magnet that is magnetically coupled to the first magnet, so that the auxiliary container is magnetically coupled to either of the storage container or the main body.

15. The cosmetic container according to claim 14, wherein the auxiliary container has a shape of a ring surrounding an outside of the storage container, and is magnetically coupled at an upper end thereof to the main body, and wherein the main body comprises the first magnet that is interiorly provided on an opposite side of the hinge part, so that a lower portion of the first magnet is magnetically coupled to the auxiliary container, and an upper portion of the first magnet is magnetically coupled to the cover.

* * * * *